US005719615A

United States Patent [19]

Hashiguchi et al.

[11] Patent Number: 5,719,615

[45] Date of Patent: Feb. 17, 1998

[54] APPARATUS FOR DRIVING HEATING ELEMENTS OF A THERMAL HEAD

[75] Inventors: Takuji Hashiguchi, Kokubu; Tamotsu Asai, Aira-gun, both of Japan

[73] Assignee: Kyocera Corporation, Kyoto, Japan

[21] Appl. No.: 642,079

[22] Filed: May 1, 1996

Related U.S. Application Data

[63] Continuation of Ser. No. 376,607, Jan. 26, 1995, abandoned, which is a continuation of Ser. No. 902,463, Jun. 19, 1992, abandoned, which is a continuation of Ser. No. 491,213, Mar. 9, 1990, abandoned.

[30] Foreign Application Priority Data

Mar. 9, 1989 [JP] Japan ..... 1-59369

[51] Int. Cl.[6] ..... B41J 2/36

[52] U.S. Cl. ..... 347/195; 347/211

[58] Field of Search ..... 347/190, 195, 347/196, 211

[56] References Cited

U.S. PATENT DOCUMENTS

| | | | |
|---|---|---|---|
| 4,409,599 | 10/1983 | Yasuda et al. | 347/190 |
| 4,563,691 | 1/1986 | Noguchi et al. | 346/76 PH |
| 4,567,488 | 1/1986 | Moriguchi et al. | 346/76 PH |
| 4,574,293 | 3/1986 | Inui et al. | 346/76 PH |
| 4,673,952 | 6/1987 | Setoyama | 347/211 |
| 4,748,455 | 5/1988 | Mori | 346/76 PH |
| 4,878,065 | 10/1989 | Fukushima et al. | 346/76 PH |
| 4,912,485 | 3/1990 | Minowa | 346/76 PH |
| 4,933,686 | 6/1990 | Izumi et al. | 346/76 PH |
| 4,955,736 | 9/1990 | Iwata et al. | 346/76 PH |
| 4,983,054 | 1/1991 | Nishiura | 346/76 PH |

FOREIGN PATENT DOCUMENTS

| | | | |
|---|---|---|---|
| 59-150768 | 8/1984 | Japan . | |
| 0158476 | 7/1986 | Japan | 346/76 PH |
| 187053 | 8/1987 | Japan | 347/211 |

*Primary Examiner*—N. Le
*Attorney, Agent, or Firm*—Loeb & Loeb LLP

[57] ABSTRACT

The past print data of plural heating resistance elements adjacently disposed are stored and latched in first latching circuit, the present print data is stored and latched in second latching circuit, and corresponding to the latched outputs of these first and second latching circuits, when the heating resistance elements have printed in the past and when the heating resistance elements adjacently to both sides of each heating resistance element are presently used in printing, it is controlled so as to shorten the driving time. As a result, blurring of the print due to excessive temperature rise of the heating resistance elements may be suppressed. Hence, the printing quality may be enhanced.

15 Claims, 4 Drawing Sheets

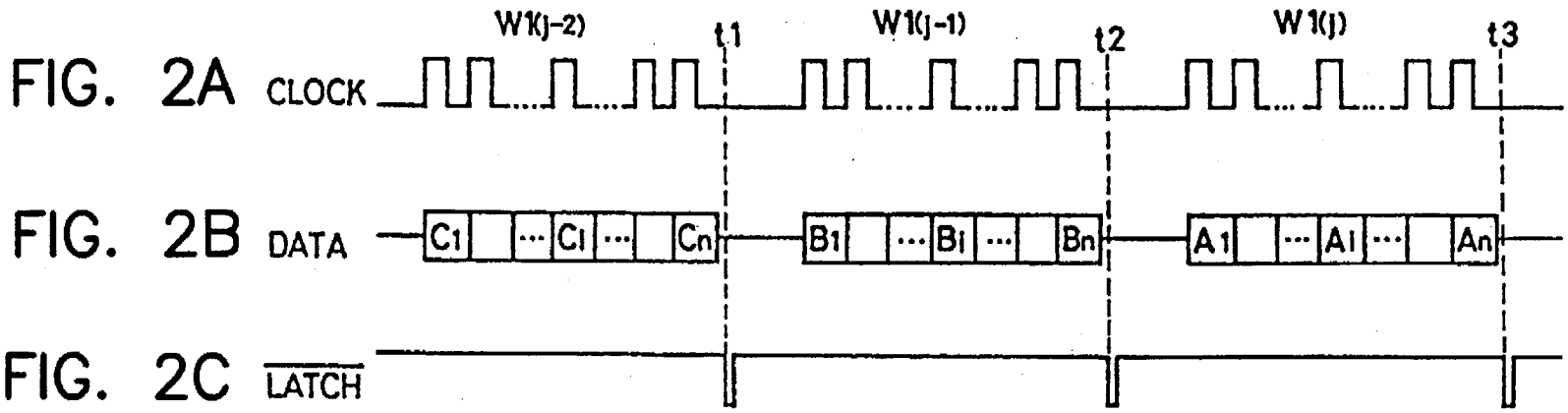
FIG. 2A
FIG. 2B
FIG. 2C
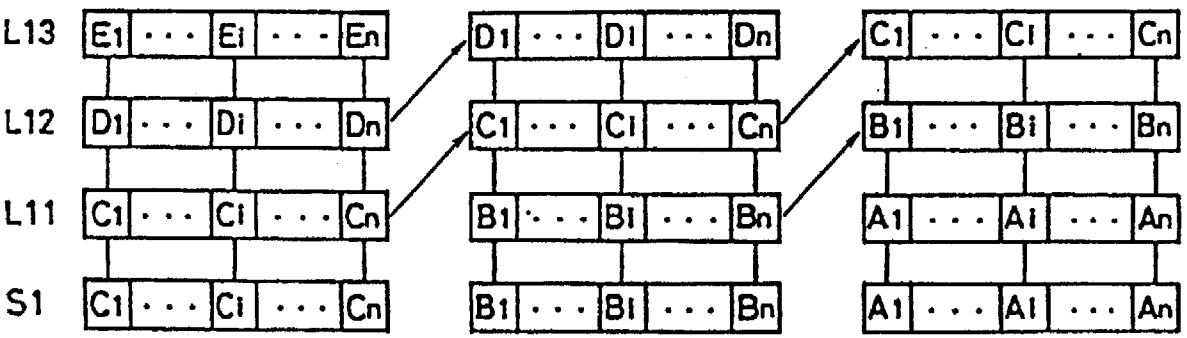
FIG. 3A
FIG. 3B
FIG. 3C

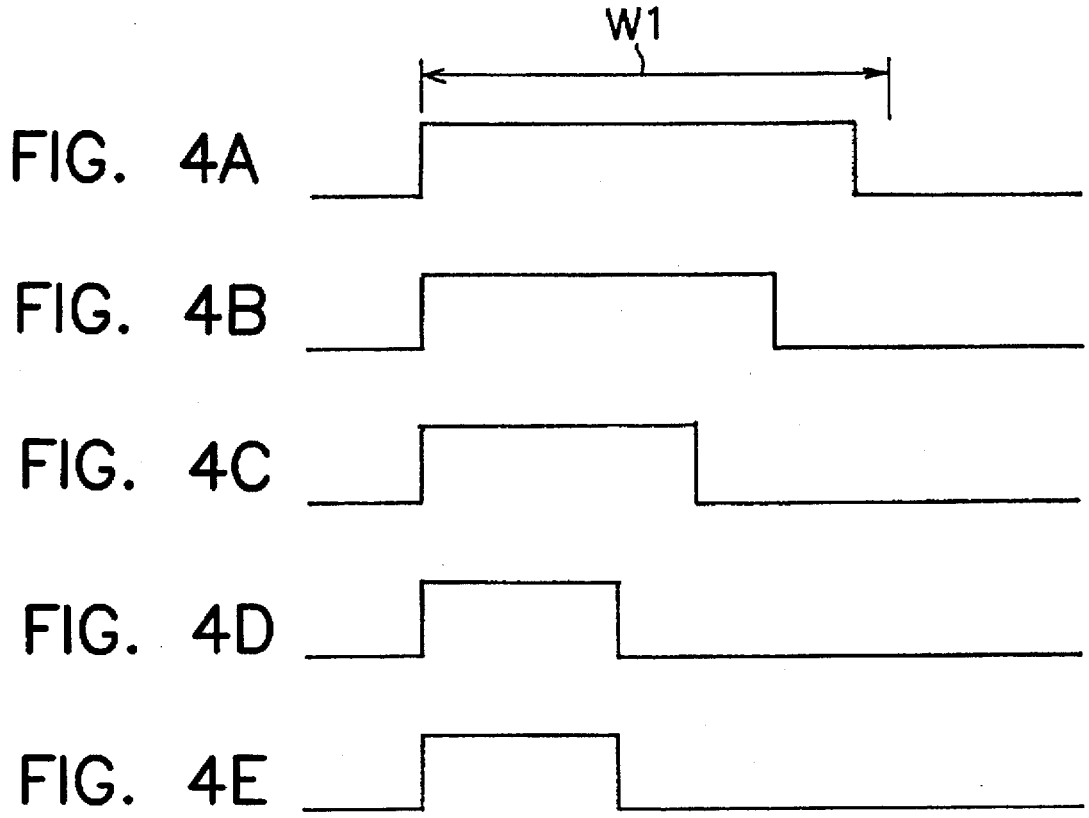
FIG. 5
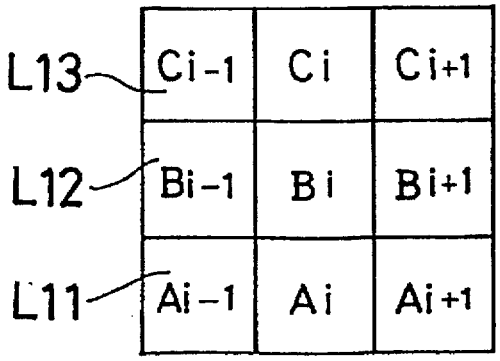

APPARATUS FOR DRIVING HEATING ELEMENTS OF A THERMAL HEAD

This is a continuation of application Ser. No. 08/376,607 filed on Jan. 26, 1995, now abandoned, which is a continuation of Ser. No. 07/902,463 filed on Jun. 19, 1992, now abandoned, which is a continuation of Ser. No. 07/491,213 filed on Mar. 9, 1990, now abandoned.

BACKGROUND OF THE INVENTION

1. Field of the Invention

The present invention relates to an apparatus for driving a thermal head of a thermal printing apparatus used, for example, as a printer for a word processor or a typewriter, or in a facsimile receiver.

2. Description of the Prior Art

In selective driving of plural heating resistance elements disposed adjacently in time sequence according to the data given to each heating resistance element, when the same heating resistance element is driven for a specific time plural times continuously, blurring of printing becomes large in the latter printing dots, and the quality of printing is lowered.

The prior art for solving this problem is disclosed, for example, in the Japanese Laid-open Patent No. 59-150768. In this prior art, the printing data for a specified number of preceding lines are stored with regard to each heating resistance element, and when printing has been done in the past by energizing a specific heating resistance element, the subsequent driving time is shortened.

In such prior art, although the driving time is controlled so that the blurring of the printed dots may be smaller on the basis of the past printing data of each heating resistance element, the printing quality is not sufficient yet.

Besides, in such prior art, in the case of discontinuous printing, since the previous print data is stored, the stored data must be cleared by using dummy data prior to writing of next print.

SUMMARY OF THE INVENTION

It is hence a primary object of the invention to present a driving apparatus of thermal head capable of enhancing the printing quality by eliminating the blurring of the print by the heating resistance elements.

An embodiment of the invention presents, therefore, a driving apparatus of thermal head for selectively driving plural heating resistance elements adjacently disposed on the basis of the printing data given in the time sequence to each heating resistance element, comprising:

first latching means L12, L13 for latching the past print data;

second latching means L11 for latching the present print data; and means for driving the heating resistance element in response to the latched outputs of the first and second latching means, by selecting the driving time of the heating resistance elements from preset plural driving times mutually differing in the durations, on the basis of the combination of the past print data stored in the first latching means for each heating resistance element, and the present print data stored in the second latching means for the heating resistance elements adjacent to both sides of the heating resistance element.

An embodiment of the invention also presents a driving device of thermal head comprising:

plural heating resistance elements 2 adjacently disposed in a straight linear row;

a print data generating source D1 for sequentially generating the print data of each heating resistance element of one row, in every time W1;

first latching means L11 for latching the print data for one row from the print data generating source, in first time W1 (j);

second latching means L12 for latching in parallel the print data stored in the first latching means L11, in second time W1 (j−1) before the first time W1 (j);

a circuit 6, 7 for calculating and setting the driving time in each time W1 corresponding to the print data stored in first latching cells Ai−1, Ai+1 in the first latching means L11 for the heating resistance elements Ri−1, Ri+1 adjacent to both side of the heating resistance element Ri, and the print data stored in second latching cell Bi in the second latching means L12 for the heating resistance element Ri, when the print data for energizing the heating resistance element Ri is stored in each latching cells Ai individually corresponding to the heating resistance element Ri of the first latching means L11; and driving means 3, 8 for driving the heating resistance element Ri only for the calculated driving time, responding to the output of the driving time calculating and setting circuit 6, 7.

Preferably, the driving time calculating and setting circuit 6, 7 comprise:

a pulse generating circuit for generating driving control pulses CTRL1 to CTRL5 possessing each pulse width of plural types for each time W1;

a selecting switch 7 for selecting the driving control pulses from the pulse generating circuit, leading out and giving to the driving means 3, 8; and an arithmetic circuit 6 for determining the switching state of the selecting switch 7, in response to the print data of the first latching cells Ai−1, Ai+1 and the second latching cell Bi.

Further preferably, there is also third latching means L13 for storing in parallel the print data stored in the second latching means L12 in third time W1 (j−2) before the second time W1 (j−1); and the driving time calculating and setting circuit 6, 7 calculate and set the driving time, in response to the print data stored in the third latching cell Ci in the third latching means L13 for the heating resistance element Ri.

According to an embodiment of the invention, the past print data of each heating resistance element is stored and latched in the first latching means, the present print data is stored and latched in the second latching means, and when each heating resistance element has printed in the past in response to the latched output of these first and second latching means, and when the heating resistance elements adjacent to both sides of each heating resistance element are printed at the present, it is controlled to shorten the printing time. As a result, blurring of the print due to excessive temperature rise of the heating resistance element may be suppressed. Hence, the printing quality may be enhanced.

In an embodiment of the invention, therefore, when each heating resistance element has been used in printing in the past, and when adjacent heating resistance elements are used in printing, it is controlled to shorten the driving time, and hence blurring of the print due to excessive temperature rise of the heating resistance element may be prevented, so that the printing quality may be enhanced.

BRIEF DESCRIPTION OF THE DRAWINGS

These and other objects of embodiment of the invention, as well as the features and advantages thereof, will be better understood and appreciated from the following detailed description taken in conjunction with the drawings, in which:

FIGS. 2(1)–2(3) and FIGS. 3(1)–3(3) are diagrams for explaining the operation of shift register S1 and latching circuits L11 to L13;

FIGS. 4(1)–4(5) are waveform diagrams of a control signal which is led out from control output terminals CTL1 to CTL5 of a processing device 5;

FIG. 5 is a drawing showing a part of each latching cell of latching circuits L11 to L13.

DETAILED DESCRIPTION OF THE PREFERRED EMBODIMENT

Figure 1:
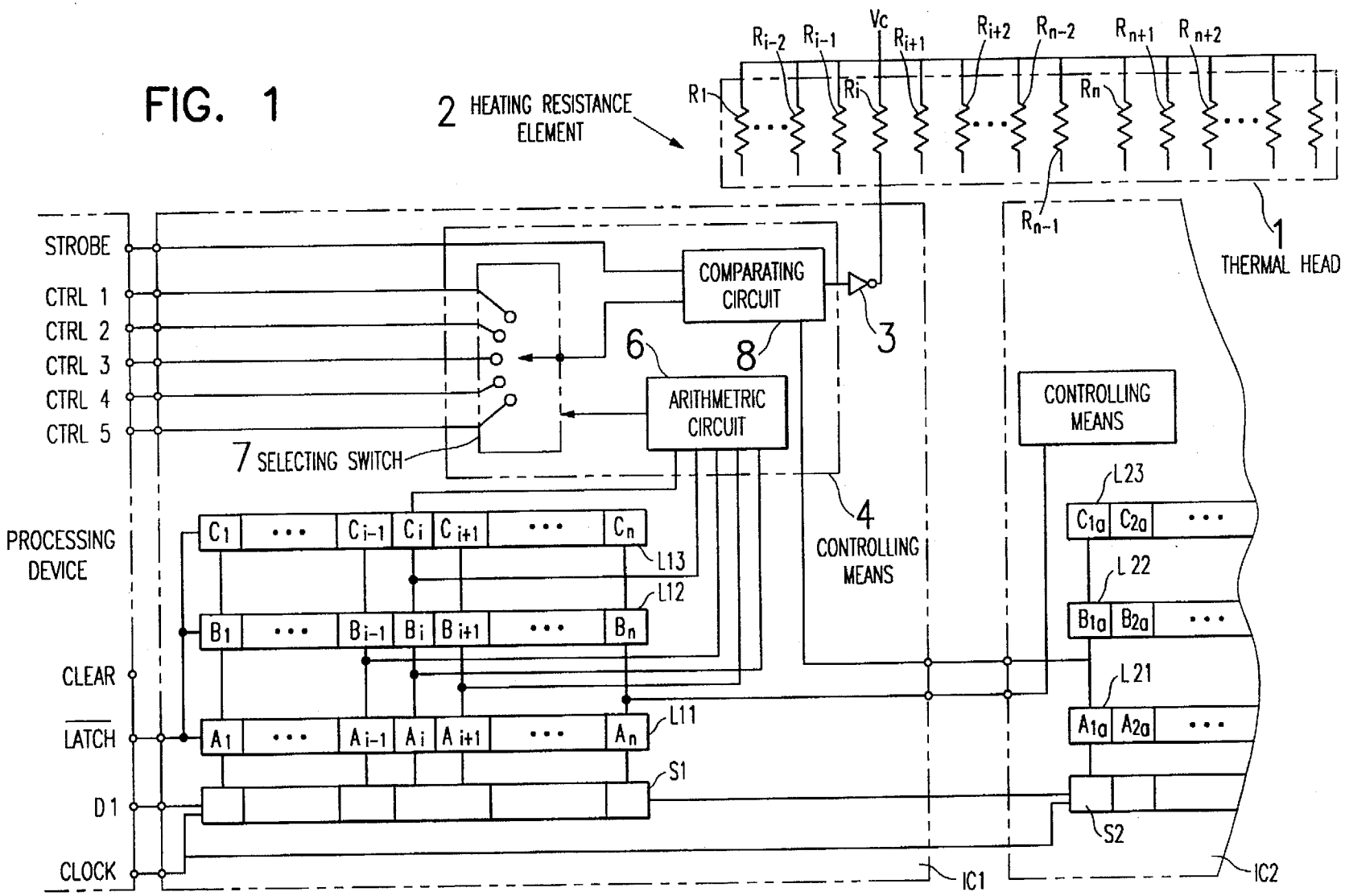
FIG. 1 is a block diagram of one of the embodiments of the invention.
Figure 6A:
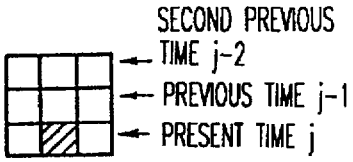
FIGS. 6(1)–6(16) are drawings showing a latching cell for explaining the operation of an arithmetic circuit 6.
Figure 6B:
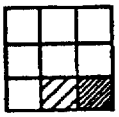
Figure 6C:
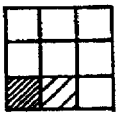
Figure 6D:
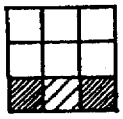
Figure 6E:
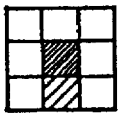
Figure 6F:
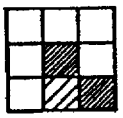
Figure 6G:
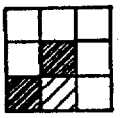
Figure 6H:
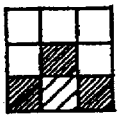
Figure 6I:
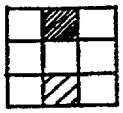
Figure 6J:
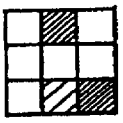
Figure 6K:
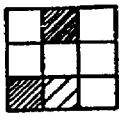
Figure 6L:
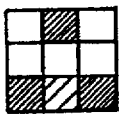
Figure 6M:
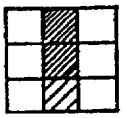
Figure 6N:
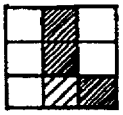
Figure 6O:
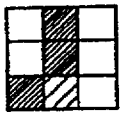
Figure 6P:
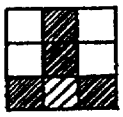

Referring now to the drawings, a preferred embodiment of the invention is described in detail below.

FIG. 1 is a block diagram of an embodiment of the invention. Adjacently to a thermal head 1, there are plural heating resistance elements 2 disposed in a straight linear form. At one end of the heating resistance elements 2, being commonly connected, a potential of one polarity +Vc of a direct-current power supply is applied. At the other end of each heating resistance element 2 (collectively expressed by reference numeral 2, and individually identified as R1, Ri, etc.), a driving circuit 3 is connected individually.

This driving circuit 3 sets the other end of the heating resistance element 2 at ground potential or high impedance. A controlling means 4 is connected to the driving circuit 3. This controlling means 4 controls the driving time in which the driving circuit 3 sets the other end of the heating resistance element 2 at the ground potential. This driving time is determined, as described later, on the basis of the past print data of each heating resistance element 2 (the print data stored in the first latching means) and the present print data of the heating resistance elements 2 adjacent to both sides (the print data stored in the second latching means).

A processing device 5 is realized by a microcomputer or the like, and from its data output terminal D1 to the shift registers S1, S2, . . . of integrated circuits IC1, IC2, . . . , the data is led out in bit series synchronously with the clock signal CLOCK. The clock signal CLOCK of the processing device 5 has the waveform as shown in FIG. 2 (1), and it causes to lead out the data in bit sequence from the data output terminal D1 synchronously with each clock signal CLOCK, and a total of n pieces of print data C1 to Cn are transferred to the shift register S1 in time W1 (j–2) [FIG. 2 (2)].

At time t1 [FIG. 2 (3)], when a latched output is delivered from the latched output terminal $\overline{\text{LATCH}}$ of the processing device 5, the latch actions are sequentially effected at three latching circuits L11, L12, L13 [FIG. 3 (1)]. That is, the latching circuit L11 latches the print data C1 to Cn of the shift register S1, and the latching circuit L12 latches the print data D1 to Dn stored in the latching circuit L11. The other latching circuit L13 latches the print data E1 to En latched in the latching circuit L12.

Consequently, from the data output terminal D1, the print data B1 to Bn are transferred to the shift register S1 in time W1 (j–1). At time t2, when the latched output is delivered, in each one of latching circuits L11 to L13, the latching action is effected as shown in FIG. 3 (2). Similarly, at time t3, the latch action is effected as shown in FIG. 3 (3).

That is, at time t3, as shown in FIG. 3 (3), the present (j) print data A1 to An are stored in the latching circuit L11, while in the latching circuit L12, the previous (j–1) print data B1 to B2 are stored, and the second previous (j–2) print data C1 to Cn are latched in the latching circuit L13. Thus, in each line of the heating resistance elements 2 of the thermal head 1, the latch action is effected in time sequence as indicated by reference codes j, j–1, j–2.

The arithmetic circuit 6 in the controlling means 4 for one heating resistance element R1 is provided with data Ai, Bi, Ci stored in the latching circuits L11, L12, L13 corresponding to the heating resistance element Ri, and is also provided with data Ai–1 and Ai+1 stored in the latching circuit L11 for the heating resistance elements Ri–1, Ri+1 adjacent to both ends of the heating resistance element Ri. In the subsequent explanation, each latching cell of the latching circuits L11 to L13 may be expressed by the same reference number as the print data.

The arithmetic circuit 6 determines the switching mode of the selecting switch 7 on the basis of the signals from these latching cells Ai, Ai–1, Ai+1, Bi, Ci. From output terminals CTL1 to CTL5 of the processing device 5, signals of drive control pulses expressing the driving times shown in FIG. 4 (1) to FIG. 4 (5) are generated at the end of latching drive after data transfer. One of the control signals CTL1 to CTL5 selected by the selecting switch 7 is given to the driving circuit 3 by way of the comparating circuit 8.

The comparating circuit 8 is made to conduct when the latching cell Ai of the latching circuit L11 is at H level to be printed and also when the output signal STROBE of the processing device 5 is at H level to be printed, and accordingly the driving circuit 3 electrically energizes the other end of Ri to set at the ground potential only for the duration predetermined by the control signal, selected by the selecting switch 7.

The arithmetic circuit 6 gives a selecting signal for selecting the drive control pulse possessing each driving time from the output terminals CTL1 to CTL5 to the selecting switch 7 according to FIG. 6 and Table 1, on the basis of the data of latching cells Ai–1, Ai+1 adjacent to both ends of the latching cell Ai corresponding to the latching circuit L11 in which the present (j) print data corresponding to the heating resistance elements Ri to be driven is latched, the data of the latching cell Bi corresponding to the latching circuit L12 in which the previous (j–1) print data is stored, and the data of the latching cell Ci of the latching circuit L13 in which the second previous (j–2) print data is stored.

FIG. 6 (1) to FIG. 6 (16) represent the latching cells shown in FIG. 5, and the latching cell Ai latching the present data corresponding to the heating resistance element Ri is to be printed, and hence it is at H level, and this latching cell Ai is indicated by shaded area, the latched data, at H level to be printed, of the latching cells Ai–1, Ai+1, Bi, Ci used in selection of driving time is indicated by dark area, while the white area shows that the data to be present is not present, at level L, and in particular the data latched in the latching cells Bi–1, Bi+1 , Ci–1, Ci+1 are not used in the operation in the arithmetic circuit 6.

TABLE 1

| | Latched data | | | Adjacent dot data | | Drive control pulse |
|---|---|---|---|---|---|---|
| FIG. 6 | Ci | Bi | Ai | Ai − 1 | Ai + 1 | FIG. 4 |
| | * | * | 0 | * | * | OFF (zero) |
| (1) | 0 | 0 | 1 | 0 | 0 | (1) |
| (2) | 0 | 0 | 1 | 0 | 1 | (2) |
| (3) | 0 | 0 | 1 | 1 | 0 | (2) |
| (4) | 0 | 0 | 1 | 1 | 1 | (3) |
| (5) | 0 | 1 | 1 | 0 | 0 | (2) |
| (6) | 0 | 1 | 1 | 0 | 1 | (3) |
| (7) | 0 | 1 | 1 | 1 | 0 | (3) |
| (8) | 0 | 1 | 1 | 1 | 1 | (4) |
| (9) | 1 | 0 | 1 | 0 | 0 | (1) |
| (10) | 1 | 0 | 1 | 0 | 1 | (2) |
| (11) | 1 | 0 | 1 | 1 | 0 | (2) |
| (12) | 1 | 0 | 1 | 1 | 1 | (3) |
| (13) | 1 | 1 | 1 | 0 | 0 | (3) |
| (14) | 1 | 1 | 1 | 0 | 1 | (4) |
| (15) | 1 | 1 | 1 | 1 | 0 | (4) |
| (16) | 1 | 1 | 1 | 1 | 1 | (5) |

Thus, when printed in the past, that is, when the past print data Bi or Ci corresponding to the heating resistance element Ri is at H level, it is controlled so as to shorten the driving time. Or when the adjacently disposed heating resistance elements Ri−1, Ri+1 are printed, that is, when the latching cells Ai−1, Ai+1 of the latching circuit L11 storing the present print data is at H level, it is controlled to shorten the driving time, and the heating resistance element Ri is driven accordingly.

On the other hand, when the heating resistance element Ri is not printed, that is, the latching cell Ai corresponding to the latching circuit L11 is at L level, the comparating circuit 8 is cut off, and the heating resistance element Ri remains de-energized.

The final latching cell An of the latching circuit L11 corresponds to the heating resistance element Rn, and the data from the latching cell An−1 adjacent thereto and the cell Ala for printing adjacent dots comprised in the latching circuit L21 of the integrated circuit IC2 next to the integrated circuit IC1 are given to the controlling means corresponding to the latching cell An.

To determine the driving time of the resistance Rn+1 corresponding to the latching cell Aln in the latching circuit L21 of the integrated circuit IC2, the data of the latching cell An in the latching circuit L11 of the integrated circuit IC1, the data of the latching cell Aln of the latching circuit L21, and the data of the latching cell Bln of the latching circuit L22 and the latching cell Cln of the latching circuit L23 are used, same as in the foregoing case of heating resistance element Ri.

In this embodiment, only the previous (j−1) data B1 and second previous (j−2) data C1 corresponding to the heating resistance element R1 are used, but (a) further past data may be used, (b) only the previous data B1 may be used, (c) only adjacent data out of the past data, for example, Bi−1, Bi−1, or Ci−1, Ci+1 may be used, (d) A1−2, Al+2 may be used, for example, or (e) the driving time may be adjusted and controlled at higher precision. Besides, after printing of one pattern, when a pulse is fed from CLEAR terminal of the processing device 5, the latched contents of the latching circuits L11, L12, L13 are cleared, so that the next print pattern may be written clearly.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. Driving apparatus composed of a plurality of integrated circuits for selectively driving plural, adjacently disposed heating resistance elements of a thermal head based on printing data given in time sequence to each of said heating resistance elements, the printing data includes past print data and present print data stored in the plurality of integrated circuits, wherein each integrated circuit of the apparatus comprises: a shift register having an input for receiving the printing data sequentially and having a plurality of output terminals for outputting printing data, the shift register connected in series with a shift register of at least one other integrated circuit of said plurality, of integrated circuits;

means for providing a latch signal;

first latching means having a plurality, of latching cells for latching a present print data and having a plurality of output terminals corresponding to the plurality of latching cells, respectively, for outputting printing data, the printing data outputted from the plurality of output terminals of the shift register being inputted into the plurality of latching cells of the first latching means in parallel in response to the latch signal;

second latching means for latching the past print data, the printing data outputted from the first latching means being inputted into the second latching means in parallel in response to the latch signal;

a plurality of input terminals for receiving a corresponding plurality of driving time signals, said driving time signals corresponding to predetermined driving times of mutually differing durations;

control means for driving each of said heating resistance elements for a selected time in response to the latched outputs of the first and second latching means, by selecting one of said input terminals and the corresponding driving time for one of the heating resistance elements, from said plural input terminals and corresponding driving times, based on a combination of the print data stored in the second latching means for said one heating resistance element, and the print data stored in the first latching means for the heating resistance elements adjacent to both sides of said one heating resistance element; and means for reducing the driving time for said heating resistance element upon the present print data stored for either one of the heating resistance elements adjacent to said one heating resistance element indicating that such adjacent heating resistance element is to be presently driven;

wherein, in at least one of said integrated circuits of the driving apparatus, the output terminal of the first latching means corresponding to at least one cell thereof is coupled to a control means of another integrated circuit of said plurality of integrated circuits.

2. Driving apparatus composed of a plurality of integrated circuits for driving heating resistance elements for selected driving times in a thermal head having plural of said heating resistance elements adjacently disposed in a substantially linear row, the driving apparatus comprising:

a print data generating source for sequentially generating, at each of first and second sequentially occurring generating times, print data for each of said heating resistance elements in the row;

wherein each integrated circuit of the driving apparatus comprises:

a shift register for receiving, in sequence, data corresponding to the print data for each of said heating resistance elements in the row generated at the first and second generating times, the shift register connected in series with a shift register of at least one other integrated circuit of said plurality of integrated circuits;

present print data latching means having a plurality of latching cells for latching in parallel data from the shift register corresponding to the print data for the row generated by the print data generating source during the first generating time, the present print data latching means having a plurality of output terminals corresponding to the plurality of latching cells, respectively;

past print data latching means coupled to the plurality of output terminals of the present print data latching means for latching in parallel, after the first generating time, data corresponding to the print data stored in the present print data latching means during the first generating time;

a plurality of input terminals for receiving a corresponding plurality of driving time signals, each driving time signal corresponding to a preset driving time;

a driving time control circuit selecting from said plurality of input terminals and corresponding preset driving times the input terminal and corresponding driving time for each of said heating resistance elements of the row such that the driving time for one of the heating resistance elements is dependent on the print data stored in the present print data latching means for the heating resistance elements adjacent to both sides of said one heating resistance element, and the print data stored in the past print data latching means for said one heating resistance element, when the print data for energizing said one heating resistance element is stored in the present print data latching means, the driving time calculating and setting circuit having an output;

said driving time control circuit including means for reducing the driving time for said one heating resistance element upon the present print data stored for either one of the heating resistance elements adjacent to said one heating resistance element indicating that such adjacent heating resistance element is to be presently driven; and driving means for driving said one heating resistance element for the calculated driving time, depending on the output of the driving time control circuit;

wherein, in at least one of said integrated circuits of the driving apparatus, the output terminal of the present print data latching means corresponding to at least one cell thereof is coupled to a driving time control circuit of another integrated circuit of said plurality of integrated circuits.

3. Driving apparatus of thermal head according to claim 2 wherein the driving time control circuit comprises:

a selecting switch having plural switching states, for selecting the driving control signals from the plural input terminals, and providing selected driving control signals to the driving means; and an arithmetic circuit for determining a switching state from said plural switching states of the selecting switch, in response to the print data stored in the present print data latching means and the past print data latching means.

4. Driving apparatus of thermal head according to claim 2 wherein there is also further print data latching means for storing in parallel the print data stored in the past print data latching means during the second generating time; and the driving time control circuit selects and sets the driving time, in response to the print data stored in the further print data latching means for the heating resistance element.

5. In a thermal printing apparatus having a first heating element disposed adjacent to each of second and third heating elements, each of said heating elements being selectively driven in response to present print data associated therewith, each of said heating elements having been previously selectively driven in response to previous print data associated therewith, the print data associated with each of said heating elements including at least one of data corresponding to a first command for driving the heating element and data corresponding to a second command for abstaining from driving the heating element, a driving apparatus composed of a plurality of integrated circuits, each integrated circuit comprising:

a shift register having an input for receiving print data sequentially and having a plurality of output terminals for outputting print data, the shift register connected in series with a shift register of at least one other integrated circuit of said plurality of integrated circuits;

a previous data latching circuit for receiving in parallel previous print data associated with each of said heating elements and for latching said previous print data, the previous print data latching circuit having a first latched output corresponding to each of said heating elements;

a present print data latching circuit coupled to the plurality of output terminals of the shift register for latching present print data associated with each of said heating elements, the present print data latching circuit having a plurality of latching cells and a plurality of output terminals corresponding to the plurality of latching cells, respectively, for providing a second latched output corresponding to each of said heating elements;

drive means for driving the first heating element upon data corresponding to said first command being included in the second latched output corresponding to the first heating element;

a plurality of input terminals, including at least first, second, third and fourth input terminals for receiving corresponding first, second, third and fourth having period signals, the first, second, third and fourth driving period signals respectively corresponding to first, second, third and fourth driving periods; and drive period control means for selecting, among said at least first, second, third and fourth input terminals and corresponding driving periods, a driving period for which the drive means drives the first heating element upon data corresponding to said first command being included in the second latched output associated with the first heating element, the selected drive period being:

(a) the first driving period upon data corresponding to said second command being included in the second latched output associated with each of the second and third heating elements;

(b) the second driving period upon data corresponding to said first command being included in only one of:

(i) the second latched output associated with the second heating element;

(ii) the second latched output associated with the third heating element;

(iii) and the first latched output associated with the first heating element;

(c) the third driving period upon data corresponding to said first command being included in only two of:

(i) the second latched output associated with the second heating element;

(ii) the second latched output associated with the third heating element, (iii) and the first latched output associated with the first heating element; and (d) the fourth driving period upon data corresponding to said first command being included in each of:

(i) the second latched output associated with the second heating element, (ii) the second latched output associated with the third heating element, and (iii) the first latched output associated with the first heating element;

wherein, in at least one of said integrated circuits of the driving apparatus, the output terminal of the present print data latching circuit corresponding to at least one cell thereof is coupled to a drive period control means of another integrated circuit of said plurality of integrated circuits.

6. Thermal printing apparatus as claimed in claim 5, wherein the first driving period is greater than the second driving period, the second driving period is greater than the third driving period and the third driving period is greater than the fourth driving period.

7. Thermal Printing apparatus according to claim 6, wherein each of the heating elements has been selectively driven in response to second previous print data associated with each of the heating elements, the second previous print data being print data provided previous to the previous print data, the driving apparatus further comprising:

a second previous print data latching circuit for latching said second previous print data associated with each of the heating elements;

wherein the plurality of input terminals includes a fifth input terminal for receiving a fifth driving period signal corresponding to a fifth driving period; and wherein the drive period control means includes means for selecting the fifth input terminal and corresponding fifth driving period signal for which the drive means drives the first heating element upon data corresponding to a first command being included in the second latched output associated with the first heating element and upon data corresponding to a first command being included in each of the present print data associated with the second heating element, the present print data associated with the third heating element, the previous print data associated with the first heating element and the second previous print data associated with the first heating element.

8. Thermal printing apparatus as claimed in claim 7, wherein the fourth driving period is greater than the fifth driving period.

9. Thermal Printing apparatus according to claim 5, wherein the drive period control means comprises:

a selecting switch for selecting one of the input terminals and corresponding driving period signals from said plurality of input terminals and corresponding driving period signals, and for transferring the selected driving period signal to the driving means; and an arithmetic circuit for controlling the selecting switch, in response to the previous and present print data latched by the previous latching circuit and the present latching circuit.

10. In a thermal printing apparatus having a first heating element disposed adjacent to each of second and third heating elements, a method employing a plurality of integrated circuits for selectively driving the adjacently disposed heating elements comprising the steps of:

receiving print data sequentially in a shift register in one of the integrated circuits of said plurality of integrated circuits, outputting print data from a plurality of output terminals of the shift register to a present print data latching circuit, and transferring the print data to a shift register of at least one other integrated circuit of said plurality of integrated circuits;

storing a first set of the print data associated with each of the heating elements in the present print data latching circuit having a plurality of latching cells and a plurality of output terminals corresponding to the plurality of latching cells, respectively;

selectively driving each of the heating elements during a first driving lime in response to the first set of print data associated with the heating elements, the first set of print data comprising for each of the heating elements at least one of data corresponding to a first command for driving a heating element and data corresponding to a second command for abstaining from driving a heating element;

transferring in parallel said first set of print data from the present print data latching circuit to a past print data latching circuit;

storing a second set of print data associated with each of the heating elements in the present print data latching circuit upon or following the step of transferring;

selectively driving each of the heating elements during a second driving time in response to a second set of print data associated with each of the heating elements, the second set of print data comprising for each of the heating elements at least one of data corresponding to a first command for driving a heating element and data corresponding to a second command for abstaining from driving a heating element; and receiving at least first, second, third and fourth driving time period signals respectively corresponding to at least first, second, third and fourth driving time periods at corresponding first, second, third and fourth input terminals;

selecting by a driving time control circuit, among at least said first, second, third and fourth input terminals and corresponding driving time period signals, an input terminal and corresponding a driving time period signal for which the first heating elements is driven upon the data of the second set of print data which is associated with the first heating element corresponding to a first command, the driving time period corresponding to the selected driving time period signal being:

(a) the first driving period upon data corresponding to a second command being included in the second print data associated with each of the second and third heating elements;

(b) the second driving period upon data corresponding to a first command being included in only one of:

(i) the second print data associates with the second heating element, (ii) the second print data associated with the third heating element, and (iii) the first print data associated with the first heating element;

(c) the third driving period upon data corresponding to a first command being included in only two of:

(i) the second print data associated with the second heating element, (ii) the second print data associated with the third heating element, and (iii) the first print data associated with the first heating element; and (d) the fourth driving period upon data corresponding to a first command being included in each of:

(i) the second print data associates with the second heating element, (ii) the second print data associated with the third heating element, and (iii) the first print data associated with the first heating element;

wherein, in at least one of said integrated circuits, the output terminal of the present print data latching circuit corresponding to at least one cell thereof is coupled to a driving time control circuit of another integrated circuit of said plurality of integrated circuits.

11. A method as claimed in claim 10, wherein the first driving period is greater than the second driving period, the second driving period is greater than the third driving period, and the third driving period is greater than the fourth driving period.

12. A method as claimed in claim 11, further comprising the steps of:

selectively driving each of the heating elements during a third driving time in response to a third set of print data associated with each of the heating elements, the third set of print data comprising for each of the heating elements at least one of data corresponding to a first command for driving a heating element and data corresponding to a second command for abstaining from driving a heating element;

receiving a fifth driving time period signal corresponding to a fifth driving time period at a fifth input terminal; and wherein the step of selecting an input terminal and corresponding driving time period signal for which the first heating element is driven comprises the step of selecting, among at least the first, second, third, fourth and fifth input terminals and corresponding driving time period signals, the fifth input terminal and corresponding fifth driving period signal being selected upon data corresponding to a first command being included in each of the second print data associated with the second heating element, the second print data associated with the third heating element, the first print data associated with the first heating element and the third print data associated with the first heating element.

13. A method as claimed in claim 10, further comprising the steps of:

generating the first set of print data during the first driving time;

storing the first set of print data with the present print data latching circuit during the first driving time;

generating the second set of print data during the second driving time;

storing the first set of print data with the past print data latching circuit during the second driving time; and storing the second set of print data with the present print data latching circuit during the second driving time;

wherein the step of selecting a driving period for which the first heating element is driven comprises the step of reading print data which is associated with the second and third heating elements and which is stored with the present print data latching circuit, reading data corresponding to the first heating element stored with the past print data latching circuit and selecting one of the first, second, third or fourth drive time periods dependent upon the data read from the present and past print data latching circuits.

14. A method as claimed in claim 13, wherein the fourth driving period is greater than the fifth driving period.

15. A method as claimed in claim 14, further comprising the steps of:

generating the third set of print data during the third driving time;

storing the first set of print data with a second past print data latching circuit during the third driving time;

storing the second set of print data with the past print data latching circuit during the third driving time; and storing the third set of print data with the present print data latching circuit during the third printing time;

wherein the step of selecting a driving period for which the first heating element is driven comprises the step of reading data associated with the second and third heating elements stored with the present print data latching circuit, reading data corresponding to the first heating element stored with the past print data latching circuit, reading data corresponding to the first heating element stored with the second past print data latching circuit and selecting one of the first, second, third, fourth or fifth drive time periods dependent upon the data read from the present, past and second past print data latching circuits.

* * * * *